US005809699A

United States Patent [19]

Joly

[11] Patent Number: 5,809,699

[45] Date of Patent: Sep. 22, 1998

[54] FIRE CURTAIN

[75] Inventor: Marc Joly, Champigny Sur Marne, France

[73] Assignee: Societe D'Exploitation Du Parc Des Expositions De La Ville De Paris, Paris, France

[21] Appl. No.: 758,285

[22] Filed: Nov. 20, 1996

[30] Foreign Application Priority Data

Nov. 20, 1995 [FR] France ..... 96 13730

[51] Int. Cl.[6] ..... E04H 9/00

[52] U.S. Cl. ..... 52/1; 52/2.22; 160/1

[58] Field of Search ..... 169/78, 50; 160/1, 160/6, 7, 9, 84.01, 84.05; 52/1, 2.11, 2.17, 2.22, 2.25

[56] References Cited

U.S. PATENT DOCUMENTS

| | | | |
|---|---|---|---|
| 1,027,308 | 5/1912 | Bishop | 169/50 |
| 2,720,269 | 10/1955 | Diacos | 169/50 |
| 3,687,185 | 8/1972 | Singer | 160/1 |
| 3,872,927 | 3/1975 | Stults | 169/48 |
| 3,877,525 | 4/1975 | Husson | 169/48 |
| 3,960,216 | 6/1976 | Isobe | 169/48 |
| 4,077,474 | 3/1978 | Hattori | 169/48 |

FOREIGN PATENT DOCUMENTS

| | | |
|---|---|---|
| 2212759 | 7/1974 | France . |
| 2287926 | 5/1976 | France . |
| 2300582 | 9/1976 | France . |
| 2586355 | 2/1987 | France . |
| 2503323 | 7/1975 | Germany . |

*Primary Examiner*—Beth Aubrey
*Attorney, Agent, or Firm*—Banner & Witcoff, Ltd.

[57] ABSTRACT

A fire curtain has its top fixed to a top framework of a building, the framework including arrangements for spraying a fluid onto the curtain having two walls fastened together along its bottom and its vertical sides. The fluid spraying arrangements spray at least one interior face of one wall with the fluid.

18 Claims, 2 Drawing Sheets

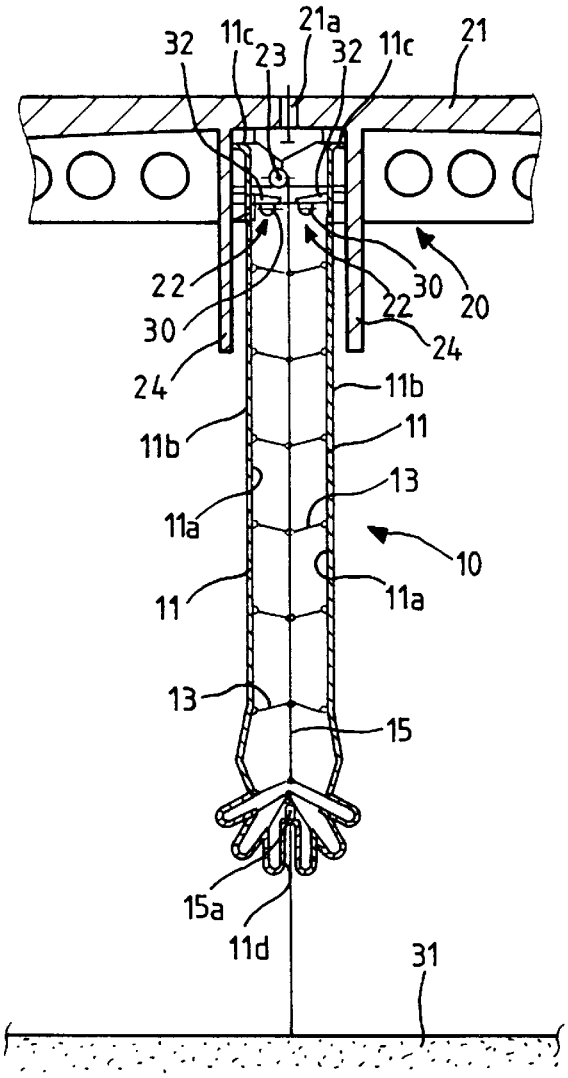
FIG_1
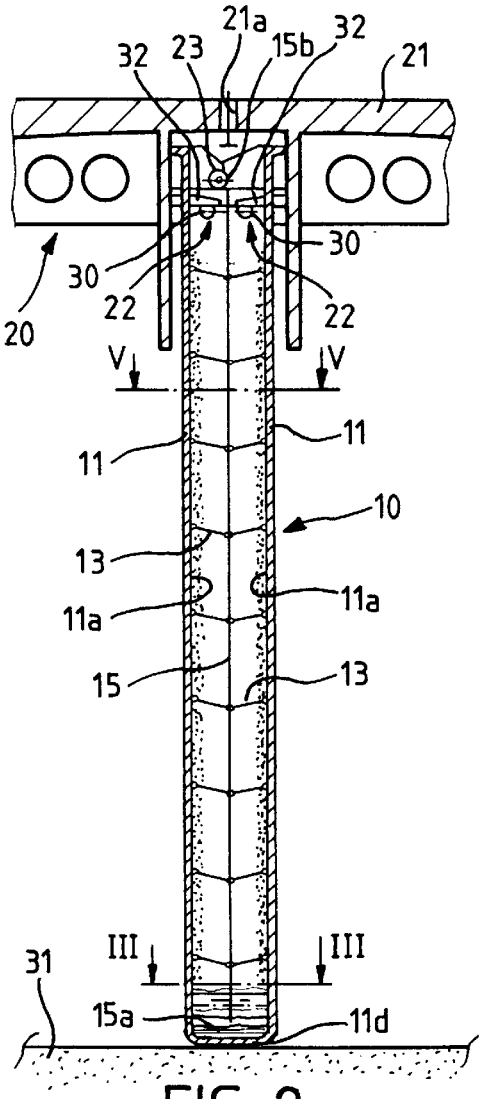
FIG_2
FIG_3
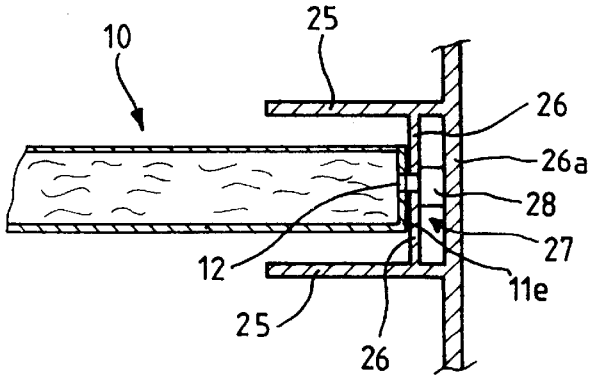

FIRE CURTAIN

BACKGROUND OF THE INVENTION

1. Field of the Invention

The present invention concerns a fire curtain.

2. Description of the Prior Art

Fire curtains are used in buildings, and in particular in establishments receiving the public, to prevent fires propagating between different parts of the building. Fire curtains are used to compartmentalize large spaces and are generally made from a fabric limiting the propagation of flames and smoke during a fire.

These curtains are generally deployed only in the event of a fire, being folded up normally.

It is known in the art to uniformly spray one of the fabric sides of conventional fire curtains to limit the propagation of heat and the increase in the temperature of the canvas fabric used in these curtains.

However, such curtains require the provision at floor level of drains for recovering the water at the bottom of the curtain. These recovery drains form obstacles and cannot be concealed by any floor covering.

Moreover, the water can be recovered correctly only if the curtain is in its normal vertical position. However, it is not rare for the curtain to be deflected from this vertical position when it is deployed in the event of a fire due to the effect of wind or because of obstacles. The water is then not recovered properly in the drains, if at all, causing flooding of the premises.

An aim of the present invention is to remove the aforementioned drawback by proposing a fire curtain increasing the protection of premises adjoining a part in which a fire has broken out.

SUMMARY OF THE INVENTION

The present invention includes a fire curtain having its top fixed to a top framework of a building, the framework including means for spraying a fluid onto the curtain which has two walls fastened together along its bottom and its vertical sides, the fluid spraying means being adapted to spray at least one interior face of one wall with the fluid.

Using this double-wall curtain, forming a pocket, and spraying the interior faces of the walls, the water is recovered within the curtain itself.

It is therefore no longer necessary to provide recovery drains in the floor.

Moreover, the risk of flooding the protected premises is entirely avoided.

In one preferred embodiment of the present invention, at least one of the vertical sides comprises near the bottom of the curtain means for evacuation of the fluid expelled from the spraying means. A wall of the building adjacent the vertical side includes fluid recovery means.

Thus if a high flowrate of fluid is used, it may be necessary to evacuate at least part of the fluid. The evacuation means enable removal of the fluid via one or both vertical sides of the curtain, at the level of the vertical walls.

In a preferred embodiment of the invention at least one of the vertical sides comprises a fluid evacuation orifice at a predetermined height above the bottom of the curtain.

Consequently, when the fluid used is a liquid such as water, a predetermined volume of the liquid accumulates in the bottom part of the curtain. The liquid trapped in the bottom part of the curtain ballasts it, so achieving effective tensioning of the curtain.

There is therefore a perfect seal against smoke or gas at floor level.

Moreover, the curtain ballasted in this way is held vertical even in the event of horizontal wind loading.

The bottom of the curtain may mate exactly with the floor and any objects that happen to be under the curtain when the latter is deployed.

In another preferred embodiment of the invention the two walls are linked by strips of equal length forming spacers.

These strips forming spacers hold the two walls of the curtain in face to face relationship.

In a preferred version the strips forming spacers are adapted to break when subjected to a tension force substantially equal to the weight of one of the two walls.

In this way, should one of the walls fall down, the other wall remains suspended from the top framework of the building.

Protection against fire is therefore guaranteed even if one part of the building collapses, a curtain of water being interposed between the remaining curtain and the fire.

Other features and advantages of the invention will be clear from the following description.

The accompanying drawings are given by way of non-limiting example.

BRIEF DESCRIPTION OF THE DRAWINGS

FIG. 1 is a sectional view of a curtain during its deployment.

FIG. 2 is a sectional view of the curtain from FIG. 1 in the deployed position.

FIG. 3 is a partial view in horizontal section on the line III—III in FIG. 2.

DETAILED DESCRIPTION OF THE PREFERRED EMBODIMENT

Figure 4E:
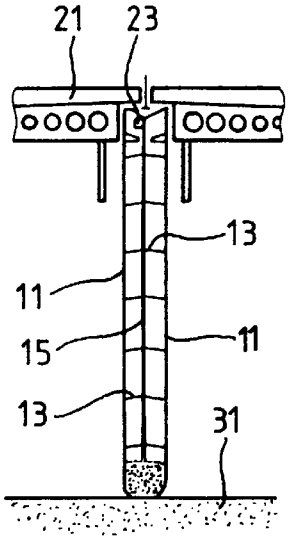
FIGS. 4A, 4B, 4C, 4D and 4E are diagrammatic views illustrating the deployment of a curtain in accordance with the invention.
Figure 4D:
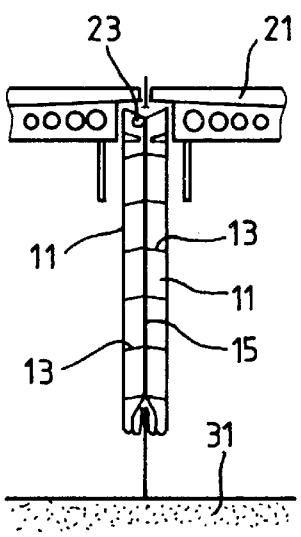
Figure 4C:
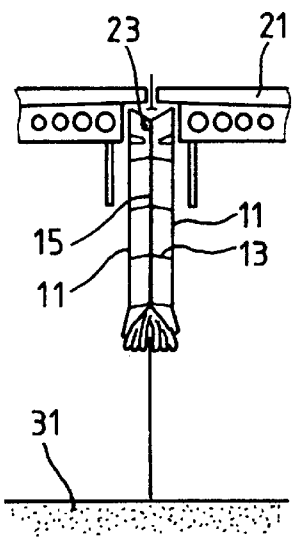
Figure 4B:
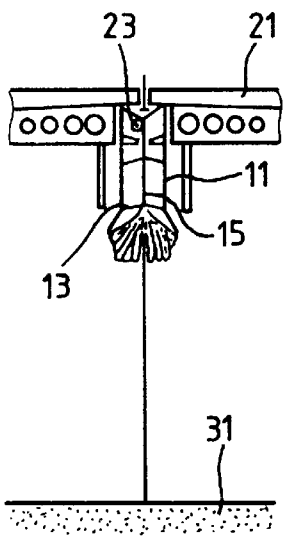

Referring first to FIG. 1, a fire curtain 10 is fixed to a top framework 21 of a building 20.

The latter may be a large building for industrial use or intended to receive a large number of persons, for example.

In the usual way it comprises a top framework 21 supporting the roof.

The curtain 10 comprises two walls 11 fastened together along its bottom 11*d* and its vertical sides 11*e*.

The two walls 11 have their top ends 11*c* fixed to the top framework 21 across the whole width of the curtain 10. Thus the curtain 10 forms a pocket suspended from the top framework 21.

The walls 11 are made from class M1 or M0 fabric for limiting the propagation of flame and hot or inflammable gases and for thermally insulating the two parts of the building separated by the curtain 10.

The walls are constructed, for example, from woven glassfiber fabric and glassfibers, woven polyester/cotton fabric or an armature of continuous ceramic fibers. The fabric is waterproof or allows only slight sweating of water in the case of a woven polyester/cotton fabric.

Means 22 for spraying a fluid onto the curtain are provided on the top framework 21 of the building 20.

In accordance with the invention, the spraying means 22 are adapted to spray the fluid onto at least one interior face 11*a* of a wall 11, i.e. one of the facing faces 11*a* of one of the two walls 11.

The fluid used in the example described below is water. A different liquid or a cooling gas could equally will be used.

As shown in FIG. 3, at least one of the vertical sides 11*e* comprises near the bottom 11*d* of the curtain 10 means 12 for evacuating the fluid from the spraying means 22.

A wall 26 of the building 20 adjacent the vertical side 11*e* of the curtain 10 includes fluid recovery means 28.

In this example the evacuation means 12 comprise an orifice at a predetermined height above the bottom 11*d* of the curtain 10.

Water escaping via the orifice 12 is recovered in the recovery means 28 which may include a pump device 28, possibly recycling the water to the spraying means 22.

As shown clearly in FIG. 2, the evacuation orifice 12 may be at a height of approximately 250 mm above the floor 31 and the bottom 11*d* of the curtain 10, i.e. equal to approximately 1/40th the total height of the curtain, so that a volume of water remains trapped within the curtain 10 with its two walls 11.

The accumulation of water in the bottom part of the curtain 10 stabilizes the latter and tensions it correctly, as well as providing a seal at the level of the floor 31 between areas separated by the curtain 10.

At the end of use of the fire curtain, or in order to maneuver it, the volume of water trapped in it may be removed by an electromechanical valve and flexible hose inserted into drain orifices 12 on each lateral side 11*e* of the curtain 10.

The spraying means 22 comprise two series of nozzles 30 disposed on the top framework 21 of the building 20. The nozzles are adapted to spray a respective interior face 11*a* of each wall 11, independently of each other.

One or other of the walls may be sprayed, or both at the same time.

The spraying means 22 comprise water feed pipes 32 equipped with nozzles uniformly distributed across the width of the curtain 10, i.e. along the top 11*e* of the curtain 10.

The spray nozzles 30 form a curtain of water over all of the interior face 11*a* of a wall 11.

In the event of a fire, this interior irrigation with water leads to evaporation of the water procuring a convection current and cooling of the members interior to the curtain 10, such as the spray system 30, 32 itself or the part of the framework 21 supporting the curtain.

Figure 5:
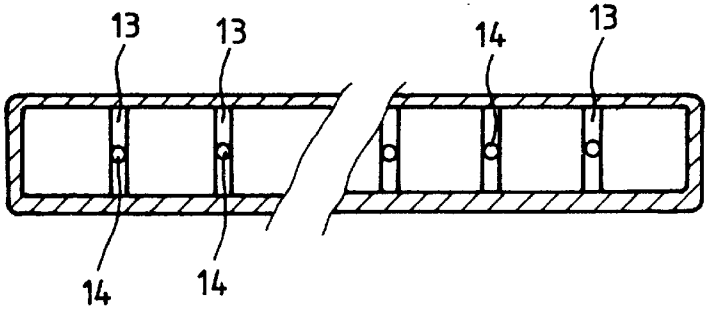
FIG. 5 is a view in section on the line V—V in FIG. 2.

As shown in FIG. 5, the two walls 11 are linked by strips 13 of equal length forming spacers to hold the two walls 11 parallel to each other.

The strips 13 may be straps made from the same fabric as the walls 11.

The strips 13 can be between 0.5 m and 1.5 m long, so determining the distance between the two walls 11. This distance is preferably between 0.8 m and 1 m.

The strips 13 forming spacers are adapted to break at a traction force substantially equal to the weight of one of the walls 11.

Thus if one part of the top framework 21 collapses with one of the walls 11, the strips 13 have a breaking capacity calculated to allow the strips 13 to be torn so that the bottom wall, on the side of the remaining area of the building, remains in place.

Accordingly, as shown in FIGS. 2 and 3, a rupture area 21*a* is provided in the framework 21 to enable one part of the building 20 to collapse, leaving the adjacent part stable. The curtain 10 of the invention extends substantially under this rupture area 21*a*.

The curtain 10 comprises a plurality of strips 13 regularly distributed along its length, as shown in FIG. 5, and a plurality of strips 13 superposed over the height of the curtain, as shown in FIG. 2.

Each strip 13 forming a spacer includes a connection piece 14 adapted to slide on a cable or tape 15 having a first end 15*a* fixed to the bottom 11*d* of the curtain and a second end 15*b* fixed to a winder 23 fastened to the top framework 21 of the building 20.

When the cable or the tape 15 is wound onto the winder 23, all of the strips 13 forming spacers are folded against each other so that the two walls 11 are folded up near the top framework 21 of the building 20.

Figure 4A:
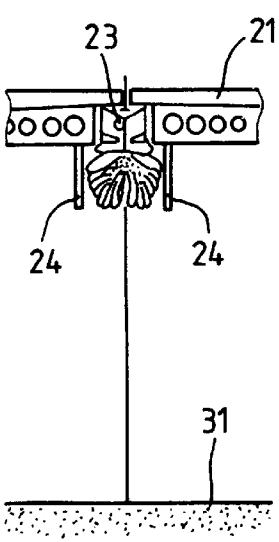

Protecting plates 24 are preferably fixed to the top framework 21 and extend towards the floor 31 a sufficient distance to conceal all of the curtain 10 when it is in the folded position as shown in FIG. 4A. These plates have a length equal to that of the curtain, between 80 m and 100 m, and a depth of approximately 0.5 m.

This depth substantially corresponds to the overall size of the folded curtain 10 if the latter has a height of approximately 10 m in the deployed position.

Similarly, protection plates 25 are fastened to vertical walls 26 of the building and extend parallel to the curtain 10, on each side of the latter.

An area 27 can be delimited by the plates 25, the vertical wall 26 adjacent a side 11*e* of the curtain 10 and a second lateral wall 26*a* parallel to the first vertical wall 26 to accommodate the water spray and recovery control mechanisms.

The protection plates 24 and 25 are preferably made from a class M0 fireproof material.

Operation will now be described with particular reference to FIGS. 4A through 4E.

In the event of a fire, deployment of the curtain 10 is commanded either manually or automatically in accordance with an instruction given by a smoke detector, for example. The winder 23 is then rotated, for example, by a motor (not shown), and the cable or tape 15 is progressively unwound. The strips 13 slide along the cable 15 as this happens so that the walls 11 are unfolded.

Spraying of the curtain is then commanded, either on both interior faces 11*a* or only on the face 11*a* of the wall exposed to the fire.

If the framework 21 of the building 20 breaks in the area on fire, the other wall 11 remains suspended from the remaining part of the building 10.

Control means known in themselves may be adapted to command automatic starting of the spray nozzles 30 spraying water onto the wall 11 that remains in place, alternating the operation of the two series of nozzles 30.

The curtain of the invention thus compartmentalizes large buildings and therefore provides a very effective means of limiting the propagation of fires.

Of course, many modifications may be made to the example described above without departing from the scope of the invention.

There is claimed:

1. A fire curtain device for installing in an area of a building to be fire-protected, said fire curtain device comprising:

a curtain including two walls fastened together along bottom and vertical sides of the curtain, each said wall having an interior face, said walls having top ends for fixing to a top framework of the building across substantially the whole width of the curtain, so that the curtain is capable of being suspended from the top framework to a floor of the building for separating a fire-protected area into at least two parts;

means for spraying a liquid onto at least one of said interior faces of said two walls, and wherein said two walls of the curtain are linked by breakable strips forming spacers adapted to break when subjected to a predetermined tension force, such that if one of said two walls collapses, said strips break while allowing the other of said two walls to remain suspended from a corresponding part of the top framework; and controls for said spraying means for spraying liquid onto said interior face of said remaining suspended wall of the curtain.

2. The fire curtain device according to claim 1, wherein said strips break under said predetermined force when one part of said top framework of the building collapses with one of said two walls.

3. The fire curtain device according to claim 2, wherein said strips have equal lengths and each strip forming a spacer includes a connecting member adapted to slide on a cable or tape having a first end fixed to said bottom side of the curtain and a second end fixed to a winder attachable to the top framework of the building.

4. The fire curtain device according to claim 1, wherein said spraying means comprise two series of nozzles disposed on said top framework of said building and each said series of nozzles is adapted to spray one interior face of a corresponding wall of the curtain.

5. The fire curtain device according to claim 4, wherein said nozzles of each series are uniformly distributed along said top ends of the two walls of the curtain.

6. The fire curtain device according to claim 1, wherein said curtain forms a pocket at a bottom portion thereof in which a predetermined volume of liquid sprayed onto the interior face of one of said walls can accumulate and be recovered.

7. The fire curtain device according to claim 6, wherein means for evacuating liquid that accumulates in said pocket are provided at at least one of said vertical sides of the curtain near a bottom of the pocket.

8. The fire curtain device according to claim 6, wherein a liquid evacuation orifice is provided in at least one of said vertical sides at a predetermined height above a bottom of said pocket.

9. The fire curtain device according to claim 7, wherein said means for evacuating include an orifice provided in said at least one of said vertical sides of said curtain at a predetermined height above a bottom of said pocket.

10. The fire curtain device according to claim 9, wherein said evacuating means include pumping means adapted to recycle the liquid to the spraying means.

11. A fire curtain device for installing in an area of a building to be fire-protected, said fire curtain device comprising:

a curtain including two walls fastened together along bottom and vertical sides of the curtain, each said wall having an interior face, said walls having top ends fixable to a top framework of the building across substantially the whole width of the curtain so that the curtain can be suspended from the top framework to a floor of the building for separating a fire-protected area into at least two parts;

means for spraying a liquid onto at least one of the interior faces of said walls and wherein said two walls of the curtain are linked by strips forming spacers which are adapted to break when subjected to a predetermined tension force whereby if one of the two walls collapses, said strips break while allowing the other of said two walls to remain suspended from a corresponding part of the top framework;

controls for said spraying means for spraying liquid onto said interior face of said remaining suspended wall of the curtain; and wherein said strips each have a substantially equal length and each strip forming a spacer includes a connecting member adapted to slide on a cable or tape having a first end fixed to said bottom side of the curtain and a second end fixed to a winder that is attachable to the top frame work of the building.

12. A fire curtain system comprising:

a fire curtain device installed in an area of a building to be fire-protected;

said fire curtain device comprising a curtain including two walls fastened together along bottom and vertical sides of the curtain, each said wall having an interior face facing the interior face of said other wall, said walls having top ends fixed to a top framework of the building across substantially the whole width of the curtain, so that the curtain is suspended from the top framework to a floor of the building for separating a fire-protected area into at least two parts;

means for spraying a liquid onto at least one of said interior faces of said two walls, and wherein said two walls of the curtain are linked by breakable strips forming spacers adapted to break when subjected to a predetermined tension force, whereby if one of said two walls collapses, said strips break while allowing the other of said two walls to remain suspended from a corresponding part of the top framework; and controls for said spraying means for spraying liquid onto said interior face of said remaining suspended wall of the curtain.

13. The fire curtain system according to claim 12, wherein said strips break under said predetermined force when one part of said top framework of the building collapses with one of the walls.

14. The fire curtain system according to claim 12, wherein said strips have equal lengths and each strip forming a spacer includes a connecting member adapted to slide on a cable or tape having a first end fixed to said bottom side of the curtain and a second end fixed to a winder attached to the top framework of the building.

15. The fire curtain system according to claim 12, wherein said curtain forms a pocket at a bottom portion thereof in which a predetermined volume of liquid sprayed onto the interior face of one of said walls can accumulate and be recovered.

16. The fire curtain system according to claim 15, wherein means for evacuating liquid that accumulates in said pocket are provided at at least one of said vertical sides of the curtain near said bottom of the pocket; and means for recovering said evacuated liquid are provided to a wall of said building adjacent to said one of said vertical sides of the curtain.

17. The fire curtain system according to claim 15, wherein a liquid evacuation orifice is provided in at least one of said vertical sides at a predetermined height above a bottom of said pocket.

18. The fire curtain system according to claim 16, wherein said means for evacuating include an orifice provided in said at least one of said vertical sides of said curtain at a predetermined height above a bottom of said pocket; and said liquid recovery means include means for evacuating the liquid escaping through said orifice.

* * * * *

UNITED STATES PATENT AND TRADEMARK OFFICE

CERTIFICATE OF CORRECTION

PATENT NO.: 5,809,699

DATED: September 22, 1998

INVENTORS: Marc JOLY

It is certified that error appears in the above-identified patent and that said Letters Patent is hereby corrected as shown below:

On the Title page, Foreign Application Priority Data, change "96 13730" to --95 13730--.

Signed and Sealed this

First Day of June, 1999

*Attest:*

Q. TODD DICKINSON

*Attesting Officer*

*Acting Commissioner of Patents and Trademarks*